US011851881B2

(12) United States Patent
Veldman et al.

(10) Patent No.: US 11,851,881 B2
(45) Date of Patent: Dec. 26, 2023

(54) REBAR POSITIONING APPARATUS

(71) Applicants: Tim Veldman, Kelowna (CA); James Veldman, Kelowna (CA); Tyler Veldman, West Kelowna (CA)

(72) Inventors: Tim Veldman, Kelowna (CA); James Veldman, Kelowna (CA); Tyler Veldman, West Kelowna (CA)

( * ) Notice: Subject to any disclaimer, the term of this patent is extended or adjusted under 35 U.S.C. 154(b) by 0 days.

(21) Appl. No.: 17/113,304

(22) Filed: Dec. 7, 2020

(65) Prior Publication Data

US 2023/0183978 A1 Jun. 15, 2023

(51) Int. Cl.
*E04C 5/20* (2006.01)

(52) U.S. Cl.
CPC ..... *E04C 5/20* (2013.01)

(58) Field of Classification Search
CPC . E04C 5/16; E04C 5/162; E04C 5/163; E04C 5/168; E04C 5/18; E04C 5/20; E04C 5/206; E04G 21/185
See application file for complete search history.

(56) References Cited

U.S. PATENT DOCUMENTS 3,319,391 A * 5/1967 Lutch ..... E04G 21/185 52/371
4,337,605 A * 7/1982 Tudek ..... E04B 2/26 52/293.2
5,456,051 A * 10/1995 Queen ..... E04C 5/20 52/677
6,176,061 B1 * 1/2001 Smith ..... E04C 5/163 52/677
9,267,287 B1 * 2/2016 Bongiorno ..... E04C 5/0604
2002/0112437 A1 * 8/2002 Queen ..... E04C 5/20 52/677
2007/0039278 A1 * 2/2007 Crowell ..... E04C 5/18 52/677
2008/0134617 A1 * 6/2008 Ripley ..... E04C 5/18 52/677
2009/0056273 A1 * 3/2009 Ferro De La Cruz ..... E04G 17/064 52/749.1
2020/0325672 A1 * 10/2020 Lucey ..... E04B 1/4107

FOREIGN PATENT DOCUMENTS

CH 670275 A5 * 5/1989 ..... E04C 5/20

* cited by examiner

*Primary Examiner* — Christine T Cajilig
(74) *Attorney, Agent, or Firm* — Orin Del Vecchio

(57) ABSTRACT

A rebar positioning apparatus configured to retain a piece of rebar and allow incremental vertical movement thereof in an upwards direction during the laying of courses of a concrete block wall. The rebar positioning apparatus of the present invention has a body wherein the body includes a center section. The center section of the body includes a first ring member and a second ring member both being annular in shape. The first ring member includes a plurality of retention members formed on the wall wherein the plurality of retention members extend inward towards the central void of the first ring member. A first support portion and a second support portion are integrally formed with the center section extending outward from opposing sides thereof. The first support portion and second support portion each have lateral support members that are v-shaped.

13 Claims, 2 Drawing Sheets

REBAR POSITIONING APPARATUS

FIELD OF THE INVENTION

The present invention relates generally to masonry construction, more specifically but not by way of limitation, a rebar positioning apparatus that facilitates the ability for a section of rebar to be held in a proper position in an aperture of a concrete block and further provide the ability for a user to adjust the rebar upward during laying of courses of concrete block so as to ensure the correct placement of the rebar in the masonry wall.

BACKGROUND

Masonry is well known in the art and has been utilized for centuries to construct buildings and other structures. While there are many types of masonry construction, the most popular is to utilize concrete block wherein the concrete block is laid in courses with mortar to construct elements such as but not limited to a wall. Depending upon the structure being built, building codes and other parameters, it is often desired or required to fill either all or a portion of the concrete block wall with poured concrete. Once a concrete block wall has been laid, or during the process thereof, poured concrete is introduced into the apertures of the concrete block and will egress therethrough so as to provide an improved structural tie in between the concrete block courses. Prior to pouring the concrete it is common to journal rebar through the concrete block courses in sections where there is some alignment with adjacent apertures and where the concrete will be poured.

As is known in the art, the positioning of rebar during the laying of concrete block courses can be cumbersome. Typical techniques include tying multiple pieces together to obtain a rebar that extends substantially vertically through the wall. Additionally, when longer rebar pieces are used this requires a mason layer to lift the concrete block over the top of the exposed rebar and place down on the lower course. The aforementioned is time consuming and when constructing a wall between existing floors is not possible. Additionally, during the aforementioned process current techniques to keep the rebar centered are cumbersome and time consuming.

It is intended within the scope of the present invention to provide a rebar positioning apparatus that is operable to facilitate the maintenance of a proper centering position of rebar and further be configured to allow the rebar to be progressively moved upward during the laying of courses of a concrete block wall.

SUMMARY OF THE INVENTION

It is the object of the present invention to provide a rebar positioning apparatus that is configured to maintain rebar in a proper centered position in a concrete block aperture wherein the present invention includes a body that is planar in manner.

Another object of the present invention is to provide an apparatus operable to facilitate the progressive upward movement ability of a section of rebar engaged therewith during the laying of courses of a concrete block wall wherein the body includes a center section.

A further object of the present invention is to provide a rebar positioning apparatus that is configured to maintain rebar in a proper centered position in a concrete block aperture wherein the body includes a first support portion and a second support portion.

Still another object of the present invention is to provide an apparatus operable to facilitate the progressive upward movement ability of a section of rebar engaged therewith during the laying of courses of a concrete block wall wherein the first support portion and the second support portion extend outward from the center section on opposing sides thereof.

An additional object of the present invention is to provide a rebar positioning apparatus that is configured to maintain rebar in a proper centered position in a concrete block aperture wherein the center section includes a first ring member and a second ring member wherein the first ring member and second ring member are adjacent and axially aligned.

Yet a further object of the present invention is to provide an apparatus operable to facilitate the progressive upward movement ability of a section of rebar engaged therewith during the laying of courses of a concrete block wall wherein the second ring member includes retention members secured to the inner circumference thereof.

Another object of the present invention is to provide a rebar positioning apparatus that is configured to maintain rebar in a proper centered position in a concrete block aperture wherein the first support portion and second support portion include a lateral support member contiguously formed on the ends thereof distal to the center section.

An alternate object of the present invention is to provide an apparatus operable to facilitate the progressive upward movement ability of a section of rebar engaged therewith during the laying of courses of a concrete block wall wherein the retention members are manufactured from a resilient material such as but not limited to rubber.

An alternative objective of the present invention is to provide a rebar positioning apparatus that is configured to maintain rebar in a proper centered position in a concrete block aperture wherein the body is manufactured from plastic.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
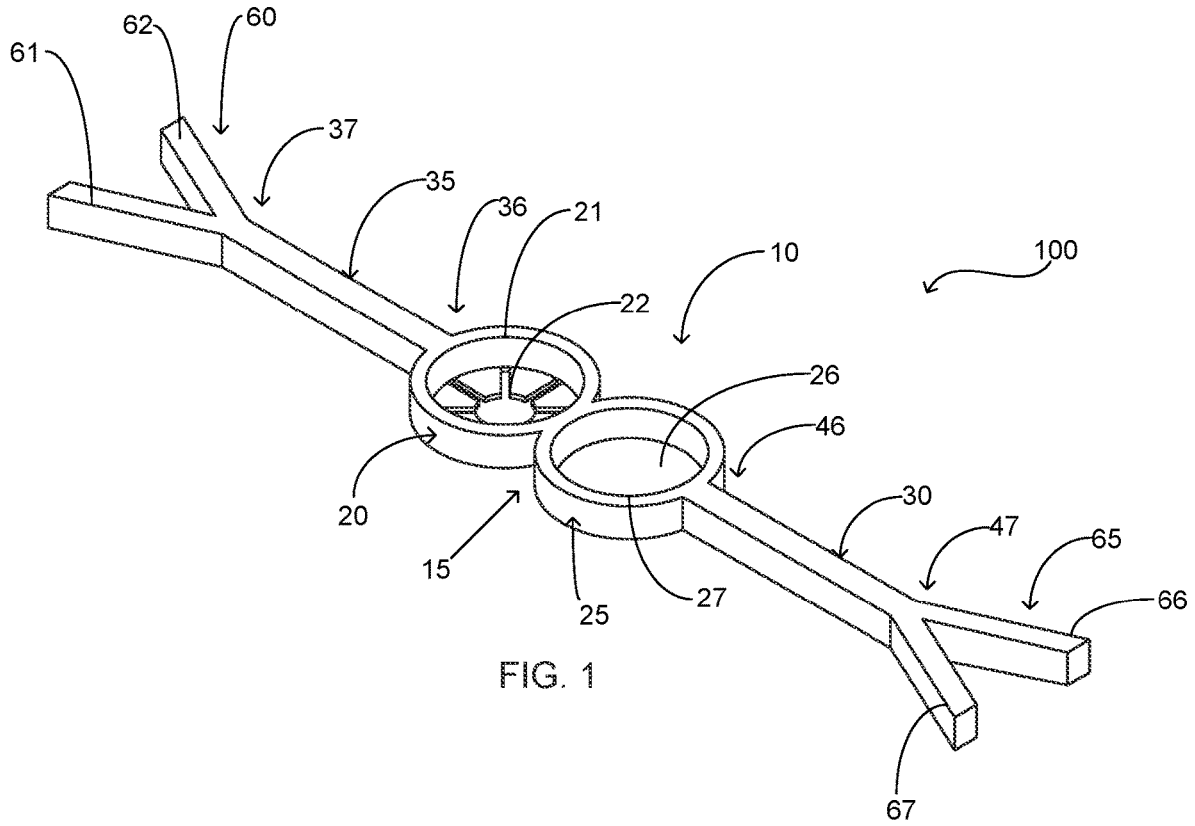
FIG. 1 is a perspective view of the present invention.

References now to the drawings submitted herewith, wherein various elements depicted therein are not necessarily drawn to scale and wherein through the views and figures like elements are referenced with identical reference numerals, there is illustrated a rebar positioning apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Drawings submitted as a part hereof, the rebar positioning apparatus 100 includes a body 10 that is planar in manner and manufactured from durable rigid material such as but not limited to plastic. The body 10 includes a center section 15 wherein the center section 15 includes a first ring member 20 and a second ring member 25. The first ring member 20 and second ring member 25 are integrally formed and adjacent each other being axially aligned. The first ring member 20 is formed with a wall 21 wherein the wall is annular in shape defining the shape of the first ring member 20. The wall 21 creates a central void 22 wherein the central void 22 sufficient in size to accommodate a metal rebar therethrough. The second ring member 25 is similarly formed as the first ring member 20 wherein the second ring member 25 includes a wall 27 defining an opening 26. The second ring member 25 is also annular in shape and has a sufficient diameter so as to accommodate a metal rebar therethrough. It should be understood within the scope of the present invention that the first ring member 20 and second ring member 25 could be provided in alternate diameters so as to receive therethrough various sizes of rebar. Furthermore, while the first ring member 20 and second ring member 25 are illustrated herein having a wall being annular in shape, it is contemplated within the scope of the present invention that the first ring member 20 and second ring member 25 could be formed from more than one wall and be formed in alternate shapes and still achieve the desired objective discussed herein.

A first support portion 35 is integrally formed with first ring member 20 extending outward therefrom. The first support portion 35 includes a first end 36 and a second end 37. First end 36 is integrally formed with first ring member 20 and the first support portion 35 is rectangular in shape. The first support portion 35 is of sufficient length so as to extend beyond the aperture 98 of concrete block 99 in order to engage the concrete block wall 97.

A second support portion 30 is integrally formed with second ring member 25 and extends outward therefrom. The second support portion 30 includes a first end 46 and a second end 47. First end 46 is integrally formed with second ring member 25 and the second support portion 30 is rectangular in shape. The second support portion 30 is of sufficient length so as to extend beyond the aperture 98 of concrete block 99 in order to engage the concrete block wall 97.

Figure 3:
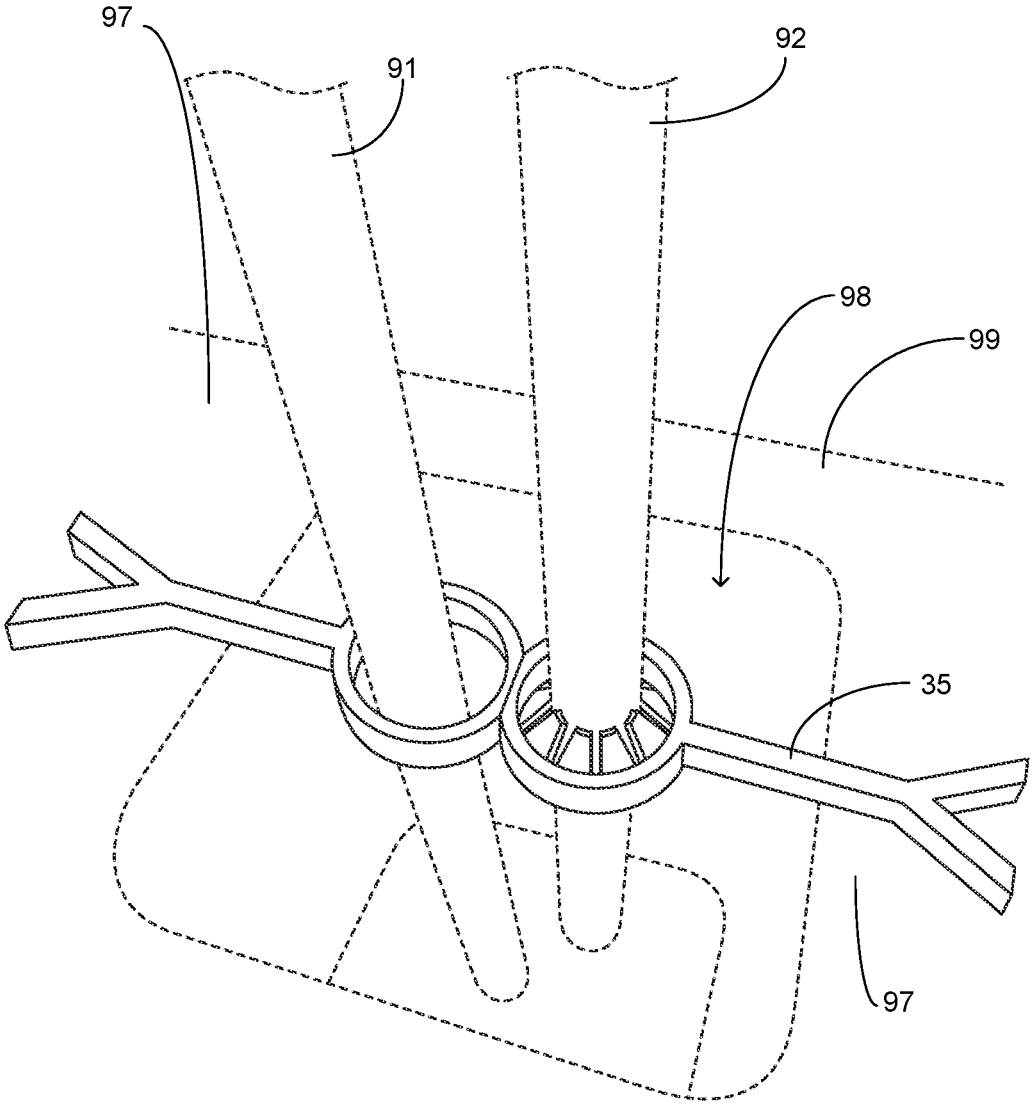
FIG. 3 is a perspective view of the present invention engaged with an exemplary rebar and concrete block.

Circumferentially disposed on the wall 21 of the first ring member 20 extending inwards towards the central void 22 are a plurality of retention members 50. The retention member 50 are secured to the wall 21 utilizing suitable durable techniques. The retention members 50 are generally tapered in shape being more narrow proximate the center of the central void 22. Retention members 50 are manufactured from resilient material such as but not limited to plastic. The retention members 50 are operable to releasably secure an exemplary piece of rebar 92 in a position such that the rebar will not slide downwards once pulled up through the retention members 50. As shown in FIG. 3 herein, first exemplary rebar 91 is journaled through the second ring member 25 and will remain in the same vertical position. As a concrete block layer adds course layers to the wall of concrete blocks, the second exemplary rebar 92 can be pulled upwards so as to be positioned proximate the top of the concrete block wall. The second piece of rebar 92 is incrementally pulled upwards as each concrete block course is laid. At the culmination of the construction of the concrete block wall, the second piece of rebar 92 will have been pulled up so as to have one end proximate the top of the concrete block wall while the distal end will be proximate a top end of the first piece of rebar 91 thus providing effective strengthening. The retention members 50 are manufactured from a stiff rubber or similar material wherein the second piece of rebar 92 once pulled up incrementally will not slide back to its starting position. It should be understood within the scope of the present invention that the first ring member 20 could have secured therein various quantities of retention members 50.

Figure 2:
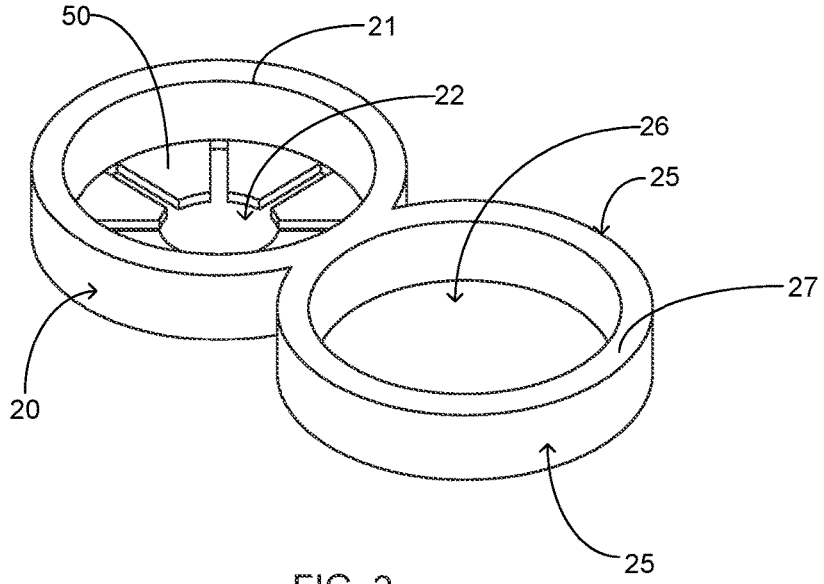
FIG. 2 is a detailed view of the center section of the present invention.

Both the first support portion 35 and the second support portion 30 have lateral support members 60, 65 contiguously formed therewith. The lateral support members 60, 65 are identically constructed wherein the lateral support member 60 includes a first section 61 and second section 62 that are angular in orientation. Additionally, lateral support member 65 includes first section 66 and second section 67 formed in an angular manner. Both the lateral support members 60, 65 are v-shaped so as to engage concrete block wall 97 and maintain stability ensuing placement thereof. It should be understood within the scope of the present invention that the lateral support members 60, 65 could be formed in alternate shapes and achieve the desired objective herein, While the body 10 has been illustrated having a first support portion 35 and second support portion 30 each being comprised as a single structure, it should be understood within the scope of the present invention that the first support portion 35 and second support portion 30 could be comprised of additional support elements and still achieve the desired objective discussed herein. It should be further understood within the scope and practice of the present invention that the center section 15 having the first ring member 20 and second ring member 25 can be deployed in a standalone configuration as shown herein in FIG. 2 wherein this configuration can be utilized for tasks such as but not limited to centering and rebar positioning.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A rebar positioning apparatus configured to be utilized during laying of multiple concrete block courses wherein the rebar positioning apparatus comprises:

a body, said body being planar in manner, said body being manufactured from a rigid material, said body having a center section, said center section having a first ring member and a second ring member, said first ring member and said second ring member being integrally formed and axially aligned, said first ring member having at least one wall forming a first central void, said second ring member having at least one wall forming a second central void;

a first support portion, said first support portion being formed with said first ring member and extending outward therefrom, said first support portion having at least one support member;

a second support portion, said second support portion being formed with said second ring member and extending outward therefrom opposite said support member of said first support portion, said second support portion having at least one support member;

a plurality of retention members, said plurality of retention members being formed on said at least one wall of said first ring member, said plurality of retention members extending inward towards said first central void of said first ring member so as to engage and support a piece of rebar placed within the first ring member, and allow the supported piece of rebar to be raised and held at a fixed height within the first ring member, and wherein said second central void is formed without any retention members.

2. The rebar positioning apparatus as recited in claim 1, wherein said first support portion includes a first end and a second end, said second end being distal to said center section.

3. The rebar positioning apparatus as recited in claim 2, wherein said second end of said first support portion further includes a lateral support member formed thereon, said lateral support member having at least two lateral support sections wherein the at least two lateral support sections are angular in manner.

4. The rebar positioning apparatus as recited in claim 3, wherein said second support portion includes a first end and a second end, said second end of said second support portion being distal to said center section.

5. The rebar positioning apparatus as recited in claim 4, wherein said second end of said second support portion further includes a lateral support member formed thereon, said lateral support member of said second support portion having at least two lateral support sections wherein the at least two lateral support sections of said lateral support member of said second support portion are angular in manner.

6. The rebar positioning apparatus as recited in claim 5, wherein the plurality of retention members are manufactured from a resilient material.

7. The rebar positioning apparatus as recited in claim 6, wherein said body is manufactured from plastic.

8. A rebar positioning apparatus configured to be utilized during laying of multiple concrete block courses so as to facilitate an ability to move a rebar in an upwards direction and maintain a position thereof while laying multiple concrete block courses wherein the rebar positioning apparatus comprises:

a body, said body being planar in manner, said body being manufactured from a rigid material, said body having a center section, said center section having a first ring member and a second ring member, said first ring member and said second ring member being integrally formed and axially aligned, said first ring member having an annular shaped wall, said annular shaped wall of said first ring member defining a first central void, said second ring member having an annular shaped wall wherein the annular shaped wall of the second ring member defines a second central void;

a first support portion, said first support portion being formed with said first ring member and extending outward therefrom, said first support portion being elongated in manner having a first end and a second end wherein the first end is formed with the first ring member;

a second support portion said second support portion being formed with said second ring member and extending outward therefrom opposite first support portion, said second support portion being elongated in manner having a first end and a second end, said first end being integrally formed with said wall of said second ring member;

a plurality of retention members, said plurality of retention members being formed on said annular wall of said first ring member, said plurality of retention members extending inward towards said first central void of said first ring member so as to engage and support a piece of rebar placed within the first ring member, and allow the supported piece of rebar to be raised and held at a fixed height within the first ring member, and wherein said second central void is formed with any retention members.

9. The rebar positioning apparatus as recited in claim 8, and further including a first lateral support member, said first lateral support member being contiguously formed with said second end of said first support portion, said first lateral support member being v-shaped.

10. The rebar positioning apparatus as recited in claim 9, and further including a second lateral support member, said second lateral support member being contiguously formed with said second end of said second support portion, said second lateral support member being v-shaped.

11. The rebar positioning apparatus as recited in claim 10, wherein said plurality of retention members are configured to retain a piece of metal rebar and are manufactured from a resilient material.

12. The rebar positioning apparatus as recited in claim 11, wherein said body is manufactured from plastic.

13. A method of laying multiple concrete courses with rebar support, comprising:

inserting a first piece of rebar into a first central void of a rebar positioning apparatus, the rebar positioning apparatus comprising:

a body, said body being planar in manner, said body being manufactured from a rigid material, said body having a center section, said center section having a first ring member and a second ring member, said first ring member and said second ring member being integrally formed and axially aligned, said first ring member having at least one wall forming the first central void, said second ring member having at least one wall forming a second central void;

a first support portion, said first support portion being formed with said first ring member and extending outward therefrom, said first support portion having at least one support member;

a second support portion said second support portion being formed with said second ring member and extending outward therefrom opposite said center section of said first support portion, said second support portion having at least on support member;

a plurality of retention members, said plurality of retention members being formed on said at least one wall of said first ring member, said plurality of retention members extending inward towards said first central void of said first ring member so as to engage and support a piece of rebar placed within the first ring member, and allow the supported piece of rebar to be raised and held at a fixed height within the first ring member, and wherein said second central void is formed without any retention members;

inserting a second piece of rebar into the second central void of the first rebar positioning apparatus;

inserting the first piece of rebar into a second central void of a second one of the rebar positioning apparatus;

inserting the second piece of rebar into a first central void of the second rebar positioning apparatus;

placing the first and second piece of rebar into the concrete course, and raising the second piece of rebar to a new height after each course of the multiple concrete courses is laid.

* * * * *